US005095846A

United States Patent [19]

Knight

[11] Patent Number: 5,095,846

[45] Date of Patent: Mar. 17, 1992

[54] BOOKMARK

[76] Inventor: John R. Knight, 426 Fairgrounds Rd., West Kingston, R.I. 02892

[21] Appl. No.: 677,996

[22] Filed: Apr. 1, 1991

[51] Int. Cl.[5] ..... B42D 9/00

[52] U.S. Cl. ..... 116/238; 116/234; 116/237

[58] Field of Search ..... 116/234–240; 281/42; 362/98, 99

[56] References Cited

U.S. PATENT DOCUMENTS

| | | | |
|---|---|---|---|
| 589,907 | 9/1897 | Pickett | 116/238 |
| 761,556 | 5/1904 | Tack | 116/238 |
| 785,215 | 3/1905 | Hill | 281/D42 |
| 803,464 | 10/1905 | Beck | 24/339 |
| 922,110 | 5/1909 | Eberle | 116/238 |
| 1,385,991 | 8/1921 | French | 116/238 |
| 3,143,998 | 8/1964 | Madden | 116/238 |

FOREIGN PATENT DOCUMENTS

| | | | |
|---|---|---|---|
| 2503328 | 10/1982 | France | 362/98 |
| 16885 | 8/1905 | United Kingdom | 116/236 |
| 25211 | 3/1912 | United Kingdom | 362/98 |
| 226439 | 12/1924 | United Kingdom | 116/239 |

*Primary Examiner*—William A. Cuchlinski, Jr.
*Assistant Examiner*—W. Morris Worth
*Attorney, Agent, or Firm*—Robert J. Doherty

[57] ABSTRACT

A multi-purpose bookmark adapted to be positioned over the top edge of the book back with an inner leg thereof extending between the pages thereof and a outer leg thereof extending downwardly along the book back outer surface and in contact therewith. Resiliently between the aforementioned legs and a spirally wound section on the outer leg provides the friction to ensure the engagement of the bookmark to the book and page position may be marked by one or more lines extending through an opening in the connecting portion between the two legs. In addition, a pencil or pen holder is provided at the outer leg.

13 Claims, 1 Drawing Sheet

BOOKMARK

BACKGROUND AND OBJECTS OF THE INVENTION

This invention relates to a multi-purpose bookmark which functions to mark the pages of a book and may further be utilized as a mechanism for holding a pen or pencil, lighting the pages being read, and serving as a marquee for advertising space for those utilizing the mark or observing such in its use position.

Bookmarks of various construction and purpose are well known and include those depicted in the following U.S. patents: U.S. Pat. No. 589,907 to Picket issued Sept. 14, 1897; U.S. Pat. No. 785,215 to Hill issued Mar. 21, 1905; U.S. Pat. No. 922,110 to Eberle issued May 18, 1909; U.S. Pat. No. 1,385,991 to French issued Aug. 2, 1921; and U.S. Pat. No. 3,143,998 to Madden issued Aug. 11, 1964. It has been generally recognized that bookmarks may also serve as mechanisms for information distribution or advertising and some of the above-indicated patents propose various manners to accomplish such by generally providing a tag either on the mechanism that serves to extend between the book pages and thus serves as a marker or at the end of a line or lines that are adapted to extend between the pages such as in the form of a tag similar to those provided for tea bags. Such known constructions while useful for the purposes indicated in connection therewith do not provide the features contemplated by the present invention—that of a bookmark functioning in a straightforward useful manner by incorporating a pair of legs one of which slides down the inside and outside surfaces of the book back or binding so as to provide one-step placement of the bookmark into the book. With the present invention, there is no further necessity to change its position vis-a-vis the book, and pages are marked by one or more strings positioned into useful proximity to the book pages by the bookmark of the present invention. Furthermore, this bookmark also provides multi-function provisions useful to the book user or reader such as lighting or pencil or pen storage in connection therewith.

A further object of the invention is the provision of a bookmark which is small and lightweight enough to be easily and unobtrusively positioned on a book or be carried on one's person.

A still further object of the present invention is, accordingly, the provision of a bookmark which can thus be placed into a book and left there permanently, if desired, and which functions to position one or more page marking lines in position to mark such pages, which line or lines are of sufficient weight to enable them to be flipped into or out of place by a quick rotational flip of the book.

These and other objects of the present invention are accomplished by a bookmark being of overall generally U-shaped configuration having a pair of opposed downwardly extending legs connected to each other at upper ends thereof by a connecting bridge, one of said legs being an inner leg in turn adapted for positioning between the book pages adjacent the binding and the other of said legs being an outside leg in turn adapted for positioning on the outside of the book adjacent the back thereof when said mark is positioned in a use position with the bridge thereof extending over the top of the book back and the legs extending downwardly on opposite sides thereof, said legs being longitudinally spaced to resiliently engage said book for positioning thereon, said inner leg of relatively straight configuration and of a thin cross-sectional lateral width so as to reduce its bulk between the pages and said outer leg having a first upper position of enlarged lateral width and exhibiting an outer surface on which indicia may be placed and a narrow lower portion of rod-like configuration extending therebelow and in contact with said book back outer surface and at least one line in the form of string or the like having a free end and a retained end wherein the free end of said line are in turn adapted to extend between said pages to mark one's place or places in said book.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
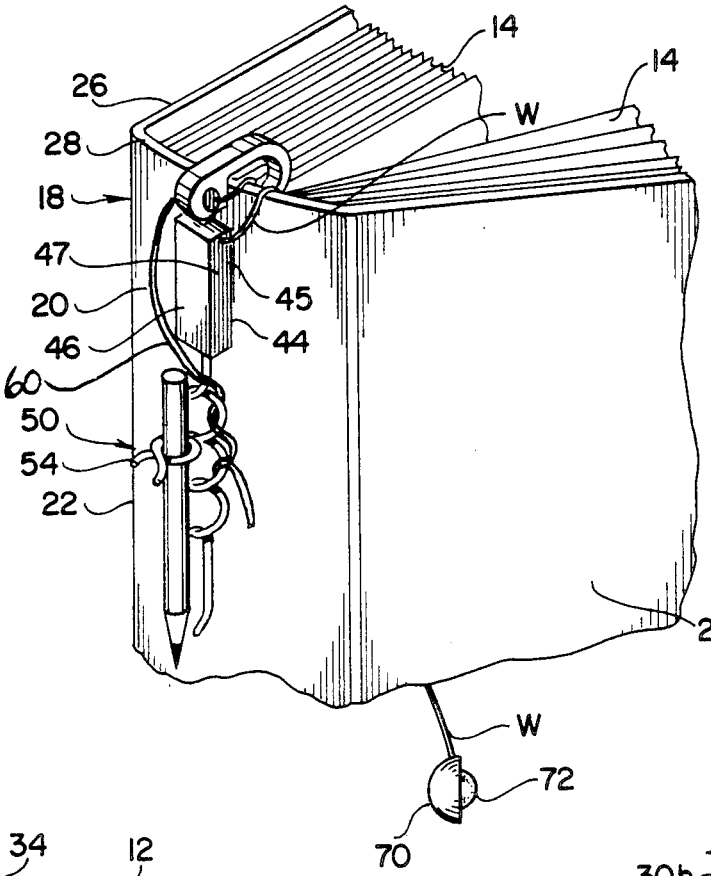
FIG. 1 is a partial perspective view showing a book in a substantially upright position with the bookmark of the present invention attached thereto in the intended manner.

Turning now to the drawings and particularly FIG. 1 thereof, the bookmark or device 10 of the present invention is shown in the preferable position mounted upon a book 12. Such book may take the form of a hard back, paperback, magazine or the like and is of conventional construction in that it includes multiple pages 14 bound at their inner edges 16 thereof, a book back or spine 18 having an outer surface 20 in part forming such binding and in turn being connected at its opposed side edges 22 to the front and back book covers 24, 26 respectively. The book back 18 further terminates in an upper edge 28 and a lower edge (not shown).

The bookmark 10 includes an inner leg 30 and an outer longitudinally opposed and spaced outer leg 32. The legs 30, 32 are connected by a connecting member or bridge 34. The bridge 34 includes an enlarged head 36 through which an opening 38 transversely extends and preferably provided with a series of transversely extending webs 40 for a purpose which will hereinafter be more fully explained.

The outer leg 32 extends downwardly from the head 36 whereas the inner leg 30 downwardly extends from an inner portion of the bridge and longitudinally inwardly disposed relative to the head 36. In either case, the legs 30, 32 may be integrally formed with the bridge 34 or may be separately attached thereto by threading, gluing, soldering or other appropriate connecting mechanisms. It is contemplated the entire device could be integrally molded of a plastic resinous material such as HDPE, polypropylene or the like. Alternatively, the leg portions 30 and 32 could be formed from wire appropriately shaped and preferably coated with a plastic material having appropriate frictional characteristics such that a desired resilient contact is effected between the book portions that contact the legs and the legs themselves. Preferably the device in its simplest form is thus small, lightweight and easily stored and transported either on one's person or unobtrusively in position upon a book.

Figure 4:
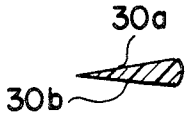
FIG. 4 is a cross-sectional view depicting a modification of the inner leg construction.
Figure 2:
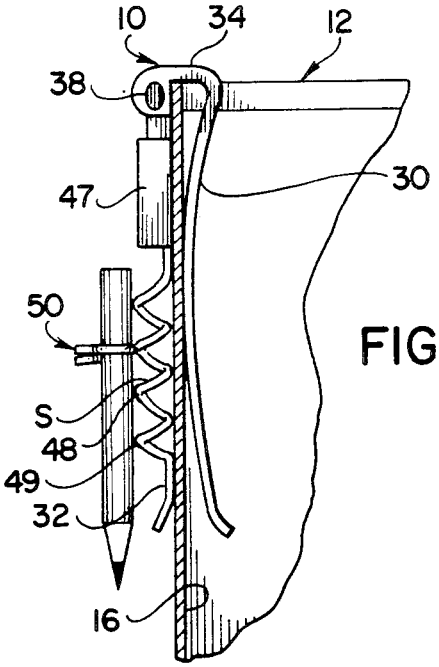
FIG. 2 is a side sectional view with parts thereof removed for clarity.
Figure 3:
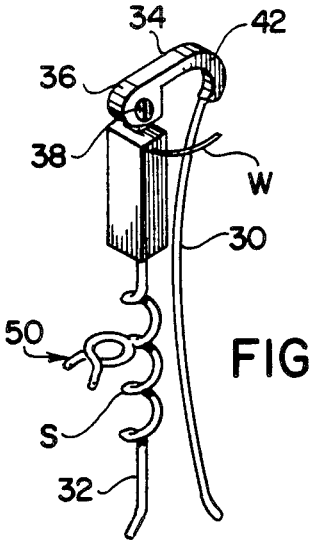
FIG. 3 is a perspective view of the bookmark shown in FIG. 2.

The bridge further includes a body portion 42 which rearwardly longitudinally extends from the head 36 and from which the inner leg downwardly depends. Such leg may be of rod-like cross-sectional configuration or alternatively, as shown in FIG. 4, have the characteristics more like a blade 30*a* as shown in the FIG. 4 drawing. Such blade 30*a* includes a narrowed front portion 30*b* adapted to extend inwardly between the pages 14 adjacent or in contact with the binding in part made up by the backing 18 inner surface. In either case, this blade is preferably of a small diameter or otherwise very narrow so as to easily fit between the pages of the book proximate its backing inner surface. Additionally, the inner leg 30 may be inwardly bowed centrally of the extent thereof to provide narrow spacings between such central area and the outer leg 32 and in this way ensure some resilient outer expansion, that is, towards the right as shown in FIGS. 2 and 3, will occur to the inner leg when it is positioned in the intended manner over the book back 18. Besides the frictional resistance caused by the surface of the legs 30, 32 themselves, such resilient contact between the legs and the binding enables the mark 10 to maintain its position on or in the book in the intended manner. In this regard, it should be brought out that the bridge body 42 rearwardly longitudinally extends from the head 36 in such a manner to present a low profile such that under portions thereof either contact the upper edge 28 or the back 18 or at least present a low profile vis-a-vis the book 12 upper portions.

The preferred outer leg 32 construction is best shown by reference to the several drawings wherein the first upper portion 44 is disposed closely adjacent the enlarged head 36. Such first outer leg portion 44 may take the form of a rectangular box presenting a generally planar outer face 42 having considerable width or lateral extent, that is, in the direction across the thickness of the book back 18. The purpose of the rather extensive outer surface 46 is to provide a marquee or surface on which advertisements may be depicted either by surface decoration by painting, coloration and the like or by molding indicia on the face thereof. The lateral extent of such first portion 44 should be, however, small enough to allow for the outer surface 20 of the backing 18 to slightly curve such as happens when the book is placed in a relatively open or flat position. The remaining outer leg 32 portions are preferably of rod-like configuration and include a generally spirally wound lower portion 48 having individual turns 49 adapted to engage the outer surface 20 of the book back 18. These spiral turns allow any additional length of page saver string 60 to be stored by quickly pulling the extra length string around in a wrapping fashion thus securing the extra length string and by stiffening the leg 32 as well as to some extent regulating the pressure brought against the book back surface 20 so as to insure the needed force to securely mount the bookmark 10 in the book 12 in the intended manner. Of course, in many cases the outer leg first upper portion 44 may simply be a continuation of rod-like configuration as when the need for a marquee or the like is not called for or when a more minimal laterl extent is desired as for thin books.

In addition, the outer leg 32 may be provided with a pencil caddy 50 including a pair of resilient generally overlapping prongs 52 which resiliently expand to an open position when their terminal ends 54 are squeezed towards each other such that a pencil, pen or the like can be longitudinally and resiliently grasped by the prongs 54 such as best shown in FIG. 1. This also assures that the pencil, etc. is accommodated to the available space at the back 18 of the book in close proximity thereto.

Figure 5:
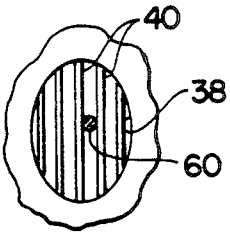
FIG. 5 is an enlarged partial elevational view showing the details of the line holder construction.

Furthermore and as best shown by FIG. 5, the opening 33 provides an intermediate anchorage for one or more lines 60 such as in the form of string, decorative thread, cords, ribbons and the like. Such line 60 running length which has opposed ends one of which is adapted to extend into the book itself, that is, between the pages thereof in the manner of a traditional bookmark, and the other end preferably adapted to extend around portions of the outer leg 32 and particularly portions of the spirally wound lower portions 48 to increase the resistance of the first end from pulling free if needed. In addition, the running length of the line 60, as previously indicated, is threaded or extended through the opening 38 between two or more adjacent transversely extending webs 40 and also dependent on the amount of frictional resistance desirable with a particular line 60. It should be apparent the more sinuous the path of the line 60 is then the greater is the frictional force applied thereto. Thus, the line can simply pass through or between two adjacent webs or pass through such and then additionally over and under another web or webs. It should also be pointed out that more than one, in fact, several, such lines may be simultaneously utilized in accordance with the present invention so that various pages may be marked by the placement of the said one or loose ends thereof between selected pages 14. Said one ends of the line or lines 60 may also either terminate within the confines of the book or extend therebelow as is desired. Also because of their connection to the device via either the opening 38 or the lower portions 48 or both, the length of the line or lines 60 can be readily adjusted to specifically match the various book sizes (length of page) or to match the paragraph or sentence you wish to return to. In other words because the line or lines 60 are adjustably mounted for quick and easy relative lengthening or shortening with respect to the page, these objectives can be achieved and present a decided advantage over marking lines that are fixedly attached to a marking device.

Additionally, the outer leg 32 upper portion 44 may take the form of a housing for a battery (not shown). In such case, the upper portion 44 may be formed of rectangular box-like construction as shown having a base wall 45 with upstanding walls 47 connected thereto to form an open face box which is closed by conventional snap action of a cover which forms the outer surface 46. In such connection, a wire W terminating in a light housing 70 and light 72 may be provided and connected to the battery via an opening 74 in one of the upstanding side walls 47. The wire W is shown as extending of a length enabling it to project below the book similar to the lines 60, but it may alternatively be provided with a shorter cord or wire W but in either event may positively provide light to assist one to read the book pages, make notes and the like.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bookmark for a book of the standard type having a plurality of pages bound along inner edges thereof and disposed between opposed covers and a generally planar back which connects such covers and in turn overlies the bound edges, said mark being of an overall generally U-shaped configuration having a pair of opposed downwardly extending legs connected to each other at upper ends thereof by a connecting bridge, one of said legs being an inner leg in turn adapted for positioning between the book pages adjacent the bound edges and the other of said legs being an outside leg in turn adapted for positioning outside of the book adjacent the back thereof when said mark is positioned in a use position with the bridge thereof extending over a top of the book back and the legs extending downwardly on opposite sides thereof, said legs being longitudinally spaced so as to resiliently engage said book for positioning thereon, said inner leg of relatively straight configuration and of a thin cross-sectional lateral width so as to reduce its bulk between the pages and said outer leg extending below said bridge and in contact with an outer surface of said book back said outer leg of a narrow lateral extent so as to enable the book back to curve as when the book is placed in an open position; and a line in the form of string or the like having a free end and a retained end wherein the free end of said line is in turn adapted to extend between said pages to mark one's place or places in said book; and means for holding said line, said outer leg having a lower portion being of rod-like configuration and including a generally spirally-shaped section having individual turns adapted for resiliently engaging said book back outer surface, said spirally-shaped section further adapted to frictionally engage portions of one end of at least one line wherein the other end of said at least one line is adapted to extend over the top of said book back and between pages of said book.

2. A bookmark for a book of the standard type having a plurality of pages bound along inner edges thereof and disposed between opposed covers and a generally planar back which connects such covers and in turn overlies the bound edges of said pages, said mark being of an overall generally U-shaped configuration having a pair of opposed downwardly extending legs connected to each other at upper ends thereof by a connecting bridge, one of said legs being an inner leg in turn adapted for positioning between the book pages adjacent the bound edges of said pages and the other of said legs being an outside leg in turn adapted for positioning outside of the book adjacent the back thereof when said mark is positioned in a use position with the bridge thereof extending over a top edge of the book back and the legs extending downwardly on opposite sides thereof, said legs being longitudinally spaced so as to resiliently engage said book for positioning thereon, said inner leg of relatively straight configuration and of a thin cross-sectional lateral width so as to reduce its bulk between the pages and said outer leg extending below said bridge and in contact with an outer surface of said book back; a line having a free end and a retained end wherein the free end of said line is adapted to extend between said pages to mark one's place or places in said book, said bridge having means for holding said line, said line holding means being a transverse passage through said bridge, said passage including an opening having at least one web extending thereacross said opening for frictionally engaging positioning of said line.

3. A bookmark for a book of the standard type having a plurality of pages bound along inner edges thereof and disposed between opposed covers and a generally planar back which connects such covers and in turn overlies the bound edges of said pages, said mark being of an overall generally U-shaped configuration having a pair of opposed downwardly extending legs connected to each other at upper ends thereof by a connecting bridge, one of said legs being an inner leg in turn adapted for positioning between the book pages adjacent the bound edges of said pages and the other of said legs being an outside leg in turn adapted for positioning outside of the book adjacent the back thereof when said mark is positioned in a use position with the bridge thereof extending over a top edge of the book back and the legs extending downwardly on opposite sides thereof, said legs being longitudinally spaced so as to resiliently engage said book for positioning thereon, said inner leg of relatively straight configuration and of a thin cross-sectional lateral width so as to reduce its bulk between the pages and said outer leg having a first upper portion of enlarged lateral width and exhibiting an outer surface on which indicia may be placed and a narrow lower portion extending therebelow and in contact with an outer surface of said book back; a line having a free end and a retained end wherein the free end of said line is adapted to extend between said pages to mark one's place or places in said book, said outer leg lower portion including a generally spirally-shaped section having individual turns adapted for resiliently engaging said book back outer surface, said spirally-shaped section further adapted to frictionally engage the retained end of said line.

4. The bookmark of claim 3, said outer leg lower portion being of rod-like configuration and having grasping means for grasping a pencil-like article, said grasping means including a pair of laterally crossed U-shaped resilient prongs.

5. The bookmark of claim 1, said outer leg lower portion being of rod-like configuration and having grasping means for grasping a pencil-like article, said grasping means including a pair of laterally crossed resilient prongs.

6. The bookmark of claim 3, said upper portion of said outer leg comprising a battery housing for a light operationally attached to a wire in turn adapted to extend between said pages like said line.

7. The bookmark of claim 1, said line being freely longitudinally adjustable with respect to said line holding means such that the effective length of the free end of the line vis-a-vis the book page is variable.

8. The bookmark of claim 3, said line being freely longitudinally adjustable with respect to said spirally-shaped section.

9. The bookmark of claim 1, said line being longitudinally adjustable with respect to said holding means such that the effective length of the free end of said line vis-a-vis the book page is variable.

10. The bookmark of claim 2, said outer leg having a lower portion including a generally spirally-shaped outer leg lower portion having individual turns adapted for frictionally engaging the retained end of said line such that said line is longitudinally adjustable with respect to said spirally wound section and such that the effective length of the free end of said line vis-a-vis the book page is variable.

11. The bookmark of claim 2, said outer leg having a first upper portion of enlarged lateral width and exhibiting an outer surface on which indicia may be placed, and a lower portion extending below upper portion.

12. The bookmark of claim 11, said outer leg lower portion having grasping means for grasping a pencil-like article.

13. The bookmark of claim 3, including line holding means positioned on said bridge, said line being freely longitudinally adjustable with respect to said bridge line holding means such that the effective length of the free end of the line vis-a-vis the book page is freely variable.

* * * * *